US008979300B1

(12) United States Patent
Chang

(10) Patent No.: US 8,979,300 B1
(45) Date of Patent: Mar. 17, 2015

(54) LED FLASHING LAMP

(71) Applicant: Sun-Hsien Chang, Dong Guan (CN)

(72) Inventor: Sun-Hsien Chang, Dong Guan (CN)

( * ) Notice: Subject to any disclaimer, the term of this patent is extended or adjusted under 35 U.S.C. 154(b) by 1 day.

(21) Appl. No.: 14/025,871

(22) Filed: Sep. 13, 2013

(51) Int. Cl.
*F21S 19/00* (2006.01)
*F21V 23/04* (2006.01)
*H05B 33/08* (2006.01)

(52) U.S. Cl.
CPC ..... *H05B 33/0809* (2013.01); *F21V 23/0407* (2013.01); *Y10S 362/80* (2013.01); *Y10S 362/802* (2013.01); *Y10S 362/806* (2013.01)
USPC ..... 362/227; 362/800; 362/802; 362/806; 362/362

(58) Field of Classification Search
USPC ..... 362/227, 251, 249, 252, 362, 363, 362/800–812
See application file for complete search history.

(56) References Cited

U.S. PATENT DOCUMENTS 6,485,169 B1 * 11/2002 Ragner ..... 362/500
2007/0285919 A1 * 12/2007 Vitulli et al. ..... 362/232
2013/0314902 A1 * 11/2013 Bushee ..... 362/103

* cited by examiner

*Primary Examiner* — Tuyet Thi Vo
(74) *Attorney, Agent, or Firm* — Alan D. Kamrath; Kamrath IP Lawfirm, P.A.

(57) ABSTRACT

A LED flashing lamp contains: a transparent housing, a cell disposed in the transparent housing, a trigger switch, a photoresistor, a controller, and at least one LED light element. The cell is connected with a power supply end of the controller, the trigger switch has a first end for connecting with a negative electrode of the cell and a second end for coupling with a signal input end of the controller via the photoresistor, the at least one LED light element is in connection with an output end of the controller.

8 Claims, 3 Drawing Sheets

LED FLASHING LAMP

FIELD OF THE INVENTION

The present invent relates to a LED flashing lamp.

BACKGROUND OF THE INVENTION

LED flashing lamp contains: a housing, a cell, a switch, a controller, and a LED light fixed in the housing. The cell is in connection with a power supply end of the controller, and the switch has a first end for connecting with a negative electrode of the cell and a second end for coupling with a signal input end of the controller. However, the LED flashing lamp is controlled by the switch to flash lights in a fixed brightness.

The present invention has arisen to mitigate and/or obviate the afore-described disadvantages.

SUMMARY OF THE INVENTION

The primary object of the present invention is to provide a LED flashing lamp which is capable of overcoming the shortcomings of the conventional LED flashing lamp.

To obtain the above objective, a LED flashing lamp provided by the present invention contains: a transparent housing, a cell disposed in the transparent housing, a trigger switch, a photoresistor, a controller, and at least one LED light element. The cell is connected with a power supply end of the controller, the trigger switch has a first end for connecting with a negative electrode of the cell and a second end for coupling with a signal input end of the controller via the photoresistor, the at least one LED light element is in connection with an output end of the controller.

Preferably, the trigger switch is a ball switch.

Preferably, the ball switch has a cylinder and a rolling ball, the cylinder has a stopping disc separately mounted on a bottom end thereof and connects with the negative electrode of the cell, the stopping disc connects with the signal input end of the controller via the photoresistor, and the rolling ball is disposed in the cylinder.

Preferably, the trigger switch is any one of a spring switch, a vibration switch, a toggle switch, and a touch switch.

Preferably, the transparent housing has a circular orifice defined thereon so as to hang a LED flashing lamp.

Preferably, the cell, the trigger switch, the photoresistor, the controller, and the at least one LED light element are integrated on a circuit board.

Preferably, three LED light elements are triangularly arranged on the circuit board.

Preferably, the transparent housing is formed in any one of a circle shape and a start shape.

Preferably, the transparent housing is made of any one of acrylic, PE (polyethylene), PC (polycarbonate), ABS resin, and epoxy.

Thereby, the LED flashing lamp of the present invention has the following advantages:

The cell, the trigger switch, the photoresistor, the controller, and the at least one LED light element are integrated on the circuit board so as to decrease a size of the LED flashing lamp and to facilitate production process.

The three LED light elements are triangularly or variably arranged on the circuit board so as to have a variable position-flashing effect.

The transparent housing is formed in a circle shape or a start shape so as to have aesthetics appearance.

The transparent housing is made of any one of acrylic, PE (polyethylene), PC (polycarbonate), ABS resin, and epoxy so as to obtain excellent transparency.

After the trigger switch is switched to supply power toward the controller, the controller detects if the resistance value of the photoresistor is higher than a set value of the controller, wherein when the resistance value of the photoresistor is higher than the set value of the controller, the controller controls its three output ends to supply power toward the three LED light elements, thus emitting flashing light in an extremely dark condition.

DETAILED DESCRIPTION OF THE PREFERRED EMBODIMENTS

Figure 1:
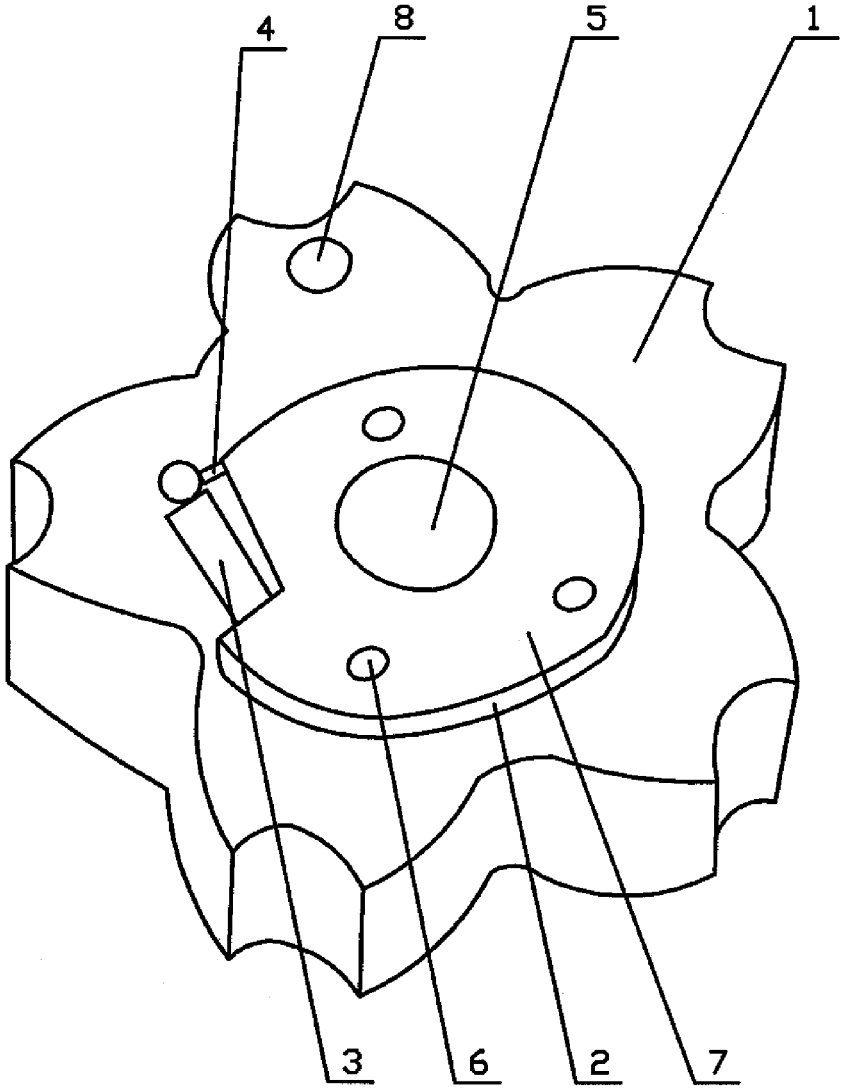
FIG. 1 is a perspective view showing the assembly of a LED flashing lamp according to a preferred embodiment of the present invention.
Figure 3:
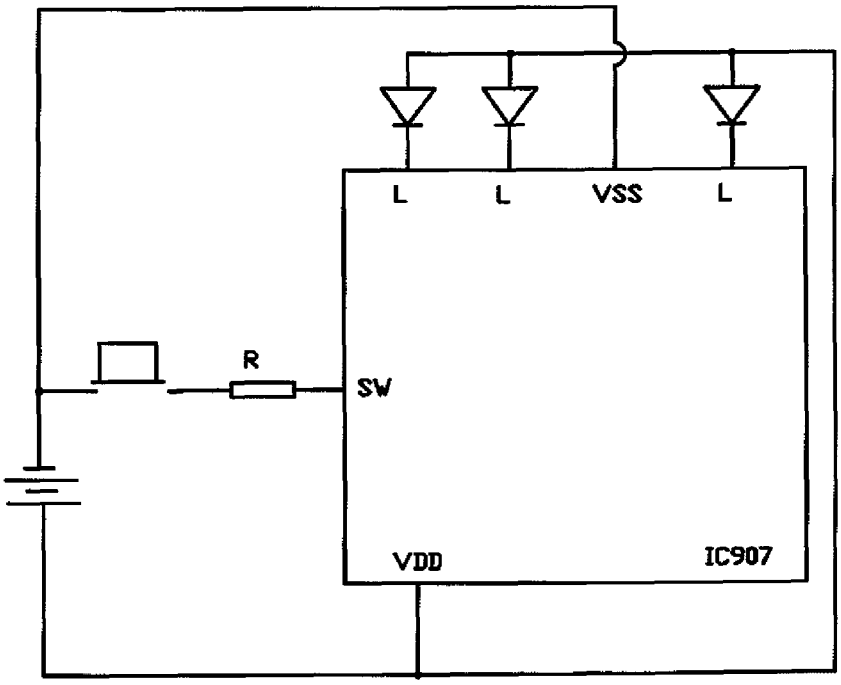
FIG. 3 is a circuit diagram of the LED flashing lamp according to the preferred embodiment of the present invention.

With reference to FIGS. 1 and 3, a LED flashing lamp according to a preferred embodiment of the present invention comprises: a transparent housing 1, a cell 2 disposed in the transparent housing 1, a trigger switch 3, a photoresistor 4, a controller 5, and at least one LED light element 6. The transparent housing 1 is made of any one of acrylic, PE (polyethylene), PC (polycarbonate), ABS resin (copolymer of acrylonitrile, butadiene, and styrene) and epoxy, and the transparent housing 1 is formed in a circle shape or a start shape. The cell 2 is connected with a power supply end of the controller 5. The trigger switch 3 has a first end for connecting with a negative electrode of the cell 2 and a second end for coupling with a signal input end of the controller 5 via the photoresistor 4. The at least one LED light element 6 is in connection with an output end of the controller 5. After the trigger switch 3 is conducted, the photoresistor 4 conducts with the signal input end of the controller 5, and then the controller 5 samples a resistance value of the photoresistor 4, wherein when the resistance value of the photoresistor 4 is higher than a set value of the controller 5, the controller 5 controls its output end to supply power toward the at least one LED light element 6, and wherein the cell 2, the trigger switch 3, the photoresistor 4, the controller 5, and the at least one LED light element 6 are integrated on a circuit board 7 so as to decrease a size of the LED flashing lamp and to facilitate production process. The controller 5 is a chip IC907, and the transparent housing 1 has a circular orifice 8 defined thereon so as to hang the LED flashing lamp. In this embodiment, three LED light elements 6 are triangularly arranged on the circuit board 7 so as to form a triangular flashing effect.

Figure 2:
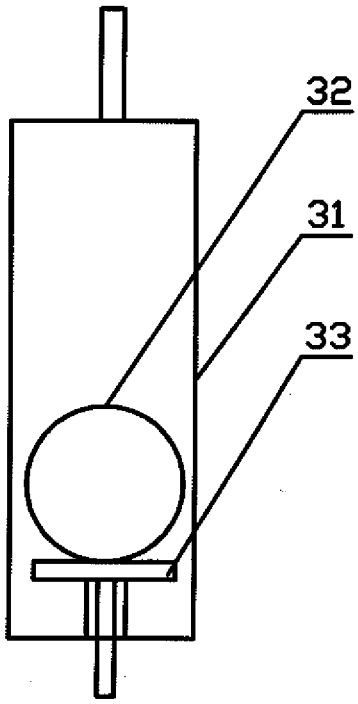
FIG. 2 is a plan view showing the assembly of a ball switch of the LED flashing lamp according to the preferred embodiment of the present invention.

It is to be noted that a varying switch is fixed on the LED flashing lamp based on using requirement. For example, the trigger switch is any one of a spring switch, a vibration switch, a toggle switch, and a touch switch. As shown in FIG. 2, the trigger switch 3 is a ball switch fixed on the LED flashing lamp and having a cylinder 31 and a rolling ball 32, the cylinder 31 has a stopping disc 33 separately mounted on a bottom end thereof and connects with the negative electrode of the cell 2, the stopping disc 33 connects with the signal input end of the controller 5 via the photoresistor 4, and the rolling ball 32 is disposed in the cylinder 31, such that when the rolling ball 32 contacts with the cylinder 31 and the stopping disc 33, the ball switch 3 is conducted.

As illustrated in FIG. 3, a circuit structure of the LED flashing lamp comprises: a positive electrode of the cell coupling with a VDD end of the chip IC907, the negative electrode of the cell connecting with a VSS end of the IC907, such that the power is supplied to the IC907. The first end of the trigger switch connects with the negative electrode of the cell, and the second end of the trigger switch coupling with a SW end of the chip IC907 through the photoresistor R, the positive electrode of the cell connects with three anodes of the three LED light elements, and three output ends of the chip IC907 couple with three cathodes of the three LED light elements, such that after the trigger switch is switched to supply power toward the chip IC907, the chip IC907 detects if the resistance value of the photoresistor R is higher than a set value of the chip IC907, wherein when the resistance value of the photoresistor R is higher than the set value of the chip IC907, the chip IC907 controls its three output ends to supply power toward the three LED light elements, thus emitting flashing light in an extremely dark condition.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A LED flashing lamp comprising:

a transparent housing, a cell disposed in the transparent housing, a trigger switch, a photoresistor, a controller, and at least one LED light element;

wherein the cell is connected with a power supply end of the controller, the trigger switch has a first end for connecting with a negative electrode of the cell and a second end for coupling with a signal input end of the controller via the photoresistor, the at least one LED light element is in connection with an output end of the controller.

2. The LED flashing lamp as claimed in claim 1, wherein the trigger switch is a ball switch.

3. The LED flashing lamp as claimed in claim 1, wherein the trigger switch is any one of a spring switch, a vibration switch, a toggle switch, and a touch switch.

4. The LED flashing lamp as claimed in claim 1, wherein the transparent housing has a circular orifice defined thereon so as to hang a LED flashing lamp.

5. The LED flashing lamp as claimed in claim 1, wherein the cell, the trigger switch, the photoresistor, the controller, and the at least one LED light element are integrated on a circuit board.

6. The LED flashing lamp as claimed in claim 5, wherein three LED light elements are triangularly arranged on the circuit board.

7. The LED flashing lamp as claimed in claim 1, wherein the transparent housing is formed in any one of a circle shape and a start shape.

8. The LED flashing lamp as claimed in claim 1, wherein the transparent housing is made of any one of acrylic, PE (polyethylene), PC (polycarbonate), ABS resin, and epoxy.

* * * * *